US008476559B2

(12) United States Patent
Hasselmann

(10) Patent No.: US 8,476,559 B2
(45) Date of Patent: Jul. 2, 2013

(54) TUNNEL FURNACE FOR THE TEMPERATURE TREATMENT OF GOODS

(75) Inventor: Wolfgang Hasselmann, Rheinfelden (DE)

(73) Assignee: Umicore AG & Co. KG, Hanau-Wolfgang (DE)

( * ) Notice: Subject to any disclaimer, the term of this patent is extended or adjusted under 35 U.S.C. 154(b) by 318 days.

(21) Appl. No.: 12/744,743

(22) PCT Filed: Nov. 24, 2008

(86) PCT No.: PCT/EP2008/066092
§ 371 (c)(1), (2), (4) Date: Jul. 16, 2010

(87) PCT Pub. No.: WO2009/068505
PCT Pub. Date: Jun. 4, 2009

(65) Prior Publication Data

US 2010/0301033 A1 Dec. 2, 2010

(30) Foreign Application Priority Data

Nov. 26, 2007 (DE) ..... 10 2007 057 237

(51) Int. Cl.
*F27B 9/06* (2006.01)

(52) U.S. Cl.
USPC ..... 219/388; 219/385

(58) Field of Classification Search
USPC ..... 219/388, 385
See application file for complete search history.

(56) References Cited

U.S. PATENT DOCUMENTS 1,488,910 A 4/1924 Dressler
2,330,984 A 10/1943 Merrill (Continued)

FOREIGN PATENT DOCUMENTS

AT 20619 9/1986
BE 557592 11/1957

(Continued)

OTHER PUBLICATIONS

International Preliminary Report on Patentability, issued in PCT/EP2008/066092, dated Jun. 1, 2010.

(Continued)

*Primary Examiner* — Julio J Maldonado
*Assistant Examiner* — Robert Bachner
(74) *Attorney, Agent, or Firm* — Brinks Hofer Gilson & Lione

(57) ABSTRACT

Tunnel kilns serve for the thermal treatment of products in a continuous operation within a production process. The tunnel kilns are usually made up of a number of identical kiln segments, each segment having a blower, heating elements for heating up the fresh air and a common exhaust air line. For the treatment of the products, they are made to pass by either on the suction side or the pressure side of the blower. To reduce the overall volume of such kilns and to save energy, it is proposed to arrange the blower inside the kiln in such a way that it produces a circulatory flow transversely to the direction of continuous transport and to transport the products to be dried through the circulatory flow parallel to one another in the direction of continuous transport both on the pressure side and on the suction side of the blower. These kilns are preferably used in the production of catalytic converters for automotive exhaust for which a catalyst layer applied to monolithic honeycomb bodies has to be dried and calcined.

13 Claims, 2 Drawing Sheets

U.S. PATENT DOCUMENTS

Figure 1:
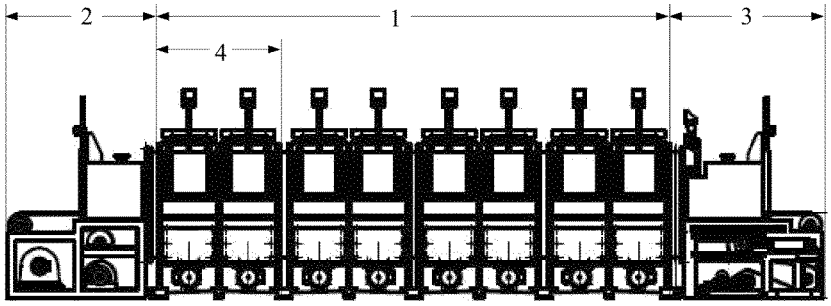

| | | | | | |
|---|---|---|---|---|---|
| 3,463,465 | A | | 8/1969 | Fuller | |
| 3,884,667 | A | * | 5/1975 | Schraven | 65/119 |
| 4,217,090 | A | * | 8/1980 | Whike et al. | 432/8 |
| 4,417,508 | A | * | 11/1983 | Haas et al. | 99/355 |
| 4,534,780 | A | | 8/1985 | Cemin | |
| 4,711,162 | A | * | 12/1987 | Eriksson | 454/263 |
| 5,004,891 | A | * | 4/1991 | Landis | 219/388 |
| 6,089,860 | A | | 7/2000 | Dull et al. | |
| 6,325,963 | B1 | | 12/2001 | Dull et al. | |
| 6,649,878 | B2 | | 11/2003 | Rehm | |
| 2003/0143098 | A1 | | 7/2003 | Weber | |

FOREIGN PATENT DOCUMENTS

| | | |
|---|---|---|
| DE | 1251470 | 10/1967 |
| DE | 2344138 | 6/1974 |
| DE | 10140007 | 3/2003 |
| EP | 0177917 | 4/1986 |
| EP | 1049904 | 11/2000 |
| EP | 1106947 | 6/2001 |
| FR | 2390691 | 12/1978 |

* cited by examiner

TUNNEL FURNACE FOR THE TEMPERATURE TREATMENT OF GOODS

This application is a national stage application of International Application No. PCT/EP2008/066092, filed Nov. 24, 2008, which claims priority to German Patent Application No. 10 2007 057 237.0, filed Nov. 26, 2007, the entire contents of which are hereby incorporated by reference.

The invention relates to a tunnel kiln for the thermal treatment of products in a continuous operation within a production process.

Tunnel kilns or continuous kilns generally comprise a number of segments that are flanged to one another. The segments form a tunnel through which the items to be treated are transported on a suitable conveyor belt. A loading station and an unloading station serve for loading and unloading the conveyor belt. The tunnel kilns are heated either by means of burners or by means of electrical heating elements.

German patent application DE 2 344 138, U.S. Pat. No. 2,330,984, Belgian patent BE 557592 and European patent application EP 0 090 790 A1 disclose tunnel kilns in which heated air driven by a blower circulates transversely to the transporting direction of the products. The circulatory flow is in this case formed in such a way that it flows in the same direction through the products located on a transporting belt over the entire width of the transporting belt. The return flow of heated air takes place by way of corresponding clearances on both sides of the transporting belt within the tunnel kiln.

European patent application EP 1 106 947 A1 describes a tunnel kiln for the heating of printed circuit boards. This kiln has, inter alia, two parallel transporting belts for the printed circuit boards.

Tunnel kilns are also used in the production of catalytic converters for automotive exhaust, for drying and calcining ceramic green bodies or a catalyst layer applied to inert supports. Tunnel kilns for the calcining of ceramic honeycomb bodies are described, for example, in U.S. Pat. Nos. 6,048,199, 6,089,860 and U.S. Pat. No. 6,325,963 B1.

The present invention is particularly concerned with a tunnel kiln for the production of catalytic converters for automotive exhaust. The products are therefore preferably monolithic supporting bodies freshly coated with catalyst material as used in the form of so-called honeycomb bodies of ceramic or metal for the production of catalytic converters for automotive exhaust. The catalyst layer must be dried and calcined. The tunnel kiln according to the invention may of course also be used for the treatment of other products.

The catalytic coating of the honeycomb bodies usually consists of a slurry of oxidative carrier materials in water. The slurry may also contain precursor compounds of catalytically active precious metals and promoters. These are often nitrates or chlorides of these precious metals and promoters, which are only transformed into the actual catalytically active components by the calcining in the tunnel kiln. Drying and calcining have the effect of releasing water vapor and nitrogen oxides or chlorine compounds, which have to be discharged together with some of the kiln air from the tunnel kiln while at the same time being replaced with fresh air, and possibly passed on to an exhaust emission control system.

From the loading station, the honeycomb bodies generally pass firstly into a drying zone, in which they are dried at a temperature of approximately 100 to 200° C. After passing through the drying zone, they enter the calcining zone, in which they are treated at temperatures of 300 to 600° C. Subsequently, they leave the tunnel kiln by way of the unloading station.

The object of the present invention is to provide a tunnel kiln which is of a particularly space-saving construction and optimally utilizes the heating energy that is used, and consequently contributes to energy saving.

This object is achieved by a tunnel kiln for the thermal treatment of products (12, 12'), which has a kiln-chamber in the form of a tunnel through which the products to be treated are transported in a direction of continuous transport, the tunnel kiln having in the direction of continuous transport a number of tunnel segments (10) that are flanged to one another. The tunnel kiln is characterized in that each tunnel segment includes at least one blower (15) and at least one heating element (17) as well as an intake channel (19) for fresh air and an exhaust channel (22) for exhaust air laden with exhaust gases and water vapor, and in that the blower(s) is/are arranged in the tunnel segments in such a way that it/they can produce a circulatory flow (23) with a downward flow and an upward flow transversely to the direction of continuous transport, with two parallel transporting belts (11, 11') for the products being provided in the downward and upward flows.

According to the invention, a circulatory flow transversely to the direction of continuous transport of the products is produced in the tunnel segments by the blower or blowers and the products to be treated are transported through the circulatory flow both on the pressure side and on the suction side of the blower. As a result, the gas stream produced is optimally utilized for the treatment of the products. Depending on the arrangement of the blowers, the downward or upward flow is located on the pressure side or the suction side of the blowers, or vice versa.

The tunnel segments preferably have a rectangular cross section and are respectively bounded by a bottom, a top and two side walls, the blowers preferably being introduced into the kiln chamber from below through the bottom. To facilitate general maintenance and repair work, the side walls of the tunnel segments may be formed in such a way that they can be swung down.

Flow baffle plates for guiding the air stream and perforated or slotted plates for providing a uniform flow onto, and possibly through, the products to be treated may be arranged in the kiln chamber. Furthermore, the flow baffle plates may be conducive to the forming of the desired circulatory flow.

Both gas or oil burners and electrical heating elements are suitable for the heating of the kiln chamber. Electrical heating elements are preferably used.

To reduce heat losses, it is advantageous to arrange the exhaust channel inside the kiln chamber. The exhaust channel collects the exhaust air of the individual circulatory flows and guides it to a central external location. If required, the exhaust air may be passed on to an exhaust emission control system.

The blowers arranged inside the tunnel segments must be maintained or repaired from time to time. In a preferred embodiment of the tunnel kiln, the blowers are therefore flanged onto the tunnel segment with part of the bottom or the side wall for the purpose of easy exchange.

Cars or transporting belts may be used for transporting the products through the tunnel kiln. Transporting belts are preferably used. In this case, the products to be treated are transported through the circulatory flows on the suction side and the pressure side of the blowers on two parallel transporting belts. For the sake of simplicity, both belts may be driven by a common drive.

Figure 3:
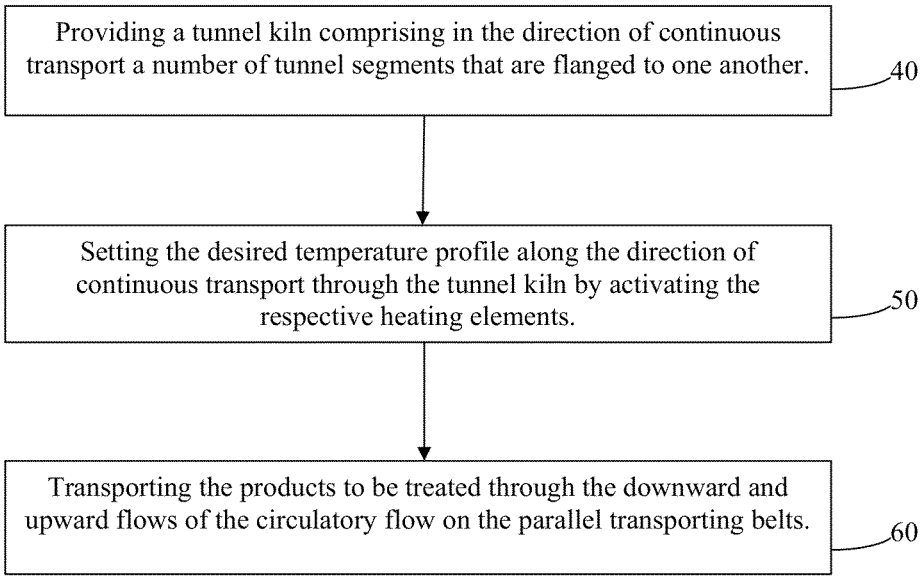

FIG. 3 shows steps for operating a tunnel kiln. The tunnel kiln is used, for example, for the drying and calcining of ceramic or metallic honeycomb bodies coated with catalyst layers for the production of catalytic converters for automotive exhaust (40). For this purpose, the desired temperature profile along the direction of continuous transport through the tunnel kiln is set by activating the heating elements of the tunnel segments (50). The products to be treated are transported through the downward and upward flows of the circulatory flow on the parallel transporting belts, some of the circulatory stream respectively being discharged to remove from the kiln exhaust gases and water vapor that are freed during the thermal treatment of the products, and replaced by a corresponding amount of fresh air (60).

The modular construction of the tunnel kiln makes it possible to insert other stations between the tunnel segments according to the invention, such as for example a station for reductive treatment of the products, for example with forming gas. Furthermore, it is possible, if required, to replace the heating by cooling in the case of selected tunnel segments.

If only small numbers of products are to be treated in the kiln, it may be advantageous to construct a batch kiln on the basis of only one tunnel segment, the conveyor belts being replaced by corresponding carrying grids.

In the case of the tunnel kilns referred to in the introductory part of the description with a circulatory flow transversely to the direction of continuous transport, the products to be treated are flowed through by the heating air only in one direction. The return flow is respectively made to pass around the outside of the products. This means that the individual tunnel segments must have a wider cross section than is necessary for the transportation of the products. By contrast with this, in the case of the present invention the return flow of the circulatory flow is also used for the treatment of the products. This allows the individual tunnel segments to be of a correspondingly more compact design. In the experience of the inventor, up to 30% of the circumferential surface area of a tunnel segment can be saved by the invention. This means a considerable saving in steel plates and thermal insulation. Furthermore, the heat emission that cannot be entirely avoided even in spite of good insulation is also reduced, to an extent corresponding to the circumferential surface area that is saved. The tunnel kiln according to the invention consequently also contributes significantly to the saving of energy.

The invention is explained in more detail on the basis of the following figures, in which:

FIG. 1: shows a side view of a tunnel kiln: and

Figure 2:
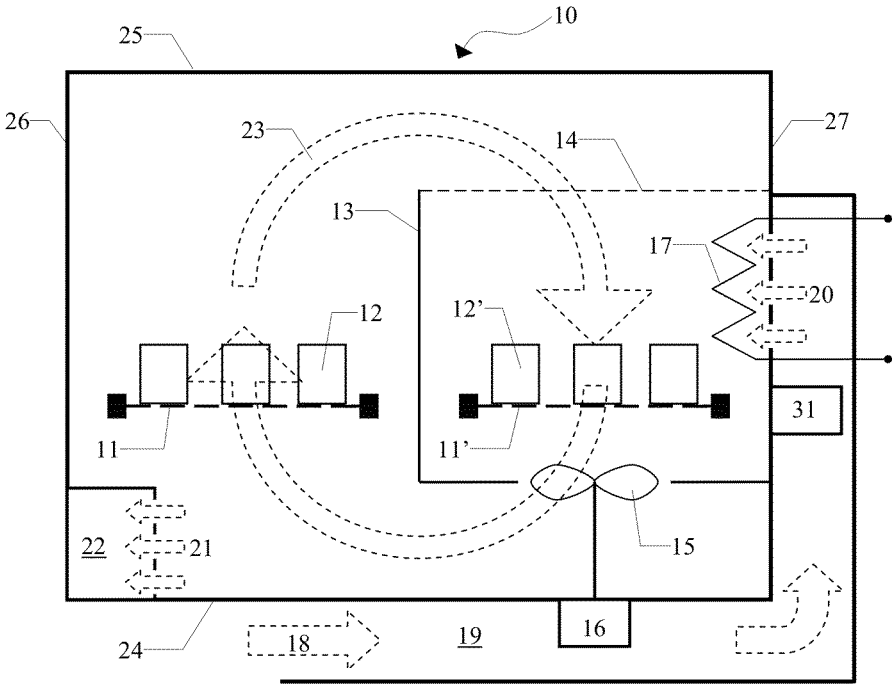

FIG. 2: shows a cross section through a tunnel segment

FIG. 3: A flow chart showing the steps for operating a tunnel kiln.

FIG. 1 shows the basic construction of a tunnel kiln (1). At the beginning of the tunnel kiln there is a loading station (2) for charging the tunnel kiln with the products to be treated and at the end of the tunnel kiln there is an unloading station (3) for removing the treated products. The tunnel kiln comprises a number of tunnel segments (4) that are flanged to one another. For the drying and calcining of catalytic converters for automotive exhaust, temperatures between 100 and 600, preferably between 100 and 500° C., are required. The modular construction of the kiln makes it possible to set the treatment temperature for each tunnel segment largely independently of neighboring segments. It is thus possible to set the temperature in the kiln downstream of the loading station, for drying the moist catalysts, between 100 and 200° C. Only after passing through this drying zone is the kiln temperature increased, for example to 300 to 600° C., in order to calcine the catalyst coating.

FIG. 2 shows by way of example the cross section of a tunnel segment (10) perpendicularly to the direction of continuous transport. The cross section of the tunnel segment is rectangular and is bounded by a bottom plate (24), a top (25) and the two side walls (26 and 27). The cross section of the tunnel kiln is divided into two halves by a vertical flow baffle plate (13). In each of both halves there is a transporting belt (11, 11') controlled by a common drive (31) for the products (12, 12') to be transported through the tunnel. The transporting belts are expediently of a perforated configuration, in order to hinder the circulatory stream as little as possible. In FIG. 2, the longitudinal extent of the transporting belts is directed perpendicularly to the plane of the drawing. A blower (15) is flanged onto the tunnel kiln from below and serves for producing the circulatory flow (23). The blower is driven by the motor (16). The gas flows in the tunnel segment are identified in FIG. 2 by arrows depicted by dashed lines. On the suction side of the blower, fresh air (18) is sucked in by way of an intake channel (19). The fresh air (20) is brought to the necessary treatment temperature by a heating element (17). For cooling the blower motor, it is advantageous to arrange the motor in the intake channel for the fresh air. The exhaust air (21), which is hot and laden with exhaust gases, is collected by an exhaust channel (22) and conducted to a central disposal location. To utilize the thermal content of the exhaust gas, it is advantageous to lay the exhaust channel (22) inside the tunnel segments. The flow conditions in the tunnel segment can be influenced by suitable flow baffle plates and screens in such a way that the products to be treated are subjected to a flow that is as uniform as possible. Only one further perforated or slotted flow baffle plate (14) is represented in FIG. 2 by way of example. The necessary thermal insulation of the walls of the tunnel segment is not shown in FIG. 2 to maintain a clear overview.

The invention claimed is:

1. A tunnel kiln with a kiln chamber and a direction of continuous transport for the thermal treatment of products, the tunnel kiln comprising in the direction of continuous transport a number of tunnel segments that are flanged to one another, wherein each tunnel segment includes at least one blower and at least one heating element as well as an intake channel for fresh air and an exhaust channel for exhaust air laden with exhaust gases and water vapor, and wherein the blower(s) is/are arranged in the tunnel segments in such a way that it/they can produce a circulatory flow with one downward flow and one upward flow transversely to the direction of continuous transport, with two parallel transporting belts for the products being provided in the downward and upward flows, and wherein the cross section of the tunnel kiln is divided into two halves by a vertical flow baffle plate.

2. The tunnel kiln of claim 1, wherein the tunnel segments have a rectangular cross section and are respectively bounded by a bottom plate, a top and two side walls, the at least one blower being introduced into the kiln chamber from below through the bottom.

3. The tunnel kiln of claim 2, wherein flow baffle plates for guiding the air stream and perforated or slotted plates for providing a uniform flow onto the products to be treated are arranged in the kiln chamber.

4. The tunnel kiln of claim 3, wherein the heating elements are electrically operated.

5. The tunnel kiln of claim 4, wherein the exhaust gas line collects the exhaust air of the individual circulatory flows and guides the exhaust air to a central external location.

6. The tunnel kiln of claim 1, wherein the two transporting belts are driven by a common drive.

7. A method for operating the tunnel kiln with a kiln chamber and a direction of continuous transport for the thermal treatment of products, comprising:

providing a tunnel kiln comprising in the direction of continuous transport a number of tunnel segments that are flanged to one another, wherein each tunnel segment includes at least one blower and at least one heating element as well as an intake channel for fresh air and an exhaust channel for exhaust air laden with exhaust gases and water vapor, and wherein the blower(s) is/are arranged in the tunnel segments in such a way that it/they can produce a circulatory flow with one downward flow and one upward flow transversely to the direction of continuous transport, with two parallel transporting belts for the products being provided in the downward and upward flows, and wherein the cross section of the tunnel kiln is divided into two halves by a vertical flow baffle plate;

setting the desired temperature profile along the direction of continuous transport through the tunnel kiln by activating the respective heating elements, and transporting the products to be treated through the downward and upward flows of the circulatory flow on the parallel transporting belts, wherein during operation some of the circulatory stream is discharged to remove from the kiln exhaust gases and water vapor that are freed during the thermal treatment of the products, and the discharged circulatory stream is replaced by a corresponding amount of fresh air.

8. A batch kiln with a kiln chamber for the thermal treatment of products, the batch kiln comprising at least one blower and at least one heating element as well as an intake channel for fresh air and an exhaust channel for exhaust air laden with exhaust gases and water vapor, wherein the at least one blower is arranged in the kiln chamber in such a way that it produces a circulatory flow with one downward flow and one upward flow in the kiln chamber, wherein the products to be treated are arranged both in the downward flow and in the upward flow, and wherein some of the circulatory stream is discharged to remove from the kiln by way of the exhaust channel exhaust gases and water vapor that are freed during the thermal treatment of the products, and the discharged circulatory stream is replaced by a corresponding amount of fresh air, and wherein the cross section of the kiln is divided into two halves by a vertical flow baffle plate and the blower is arranged in one of the halves of said cross section.

9. The tunnel kiln of claim 1, wherein the blower is arranged below one of the transporting belts carrying a part of the goods.

10. The tunnel kiln of claim 1, wherein the blower is driven by a motor, wherein said motor is arranged in the intake channel for fresh air.

11. The batch kiln of claim 8, wherein the blower is driven by a motor, wherein said motor is arranged in the intake channel for fresh air.

12. The tunnel kiln of claim 1, wherein the exhaust gas line collects the exhaust air of the individual circulatory flows and guides the exhaust air to a central external location and wherein the exhaust gas line is arranged inside the tunnel segments of the tunnel kiln.

13. The batch kiln of claim 8, wherein the exhaust channel collects the exhaust air of the individual circulatory flows and guides the exhaust air to a central external location and wherein the exhaust gas line is arranged inside the tunnel segments of the tunnel kiln.

* * * * *

UNITED STATES PATENT AND TRADEMARK OFFICE

CERTIFICATE OF CORRECTION

PATENT NO. : 8,476,559 B2
APPLICATION NO. : 12/744743
DATED : July 2, 2013
INVENTOR(S) : Wolfgang Hasselmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 370 days.

Signed and Sealed this
Eighth Day of September, 2015

Michelle K. Lee

Michelle K. Lee
*Director of the United States Patent and Trademark Office*